US010478789B2

(12) United States Patent
Lei et al.

(10) Patent No.: US 10,478,789 B2
(45) Date of Patent: Nov. 19, 2019

(54) MATERIAL STIRRING DEVICE FOR BIOMASS BIN

(71) Applicant: ENERGY RESEARCH INSTITUTE CO., LTD, HENAN ACADEMY OF SCIENCES, Henan (CN)

(72) Inventors: Tingzhou Lei, Zhengzhou (CN); Zhiwei Wang, Zhengzhou (CN); Zaifeng Li, Zhengzhou (CN); Xiaofeng He, Zhengzhou (CN); Shuhua Yang, Zhengzhou (CN); Xinguang Shi, Zhengzhou (CN); Ju Xiao, Zhengzhou (CN); Jinling Zhu, Zhengzhou (CN)

(73) Assignee: Energy Research Institute Co., LTD, Henan Academy of Sciences, Henan (CN)

( * ) Notice: Subject to any disclaimer, the term of this patent is extended or adjusted under 35 U.S.C. 154(b) by 207 days.

(21) Appl. No.: 15/534,031

(22) PCT Filed: Jun. 26, 2015

(86) PCT No.: PCT/CN2015/082440
§ 371 (c)(1),
(2) Date: Jun. 8, 2017

(87) PCT Pub. No.: WO2016/112645
PCT Pub. Date: Jul. 21, 2016

(65) Prior Publication Data

US 2018/0104660 A1 Apr. 19, 2018

(30) Foreign Application Priority Data

Jan. 16, 2015 (CN) ..... 2015 1 0022409

(51) Int. Cl.
*B01F 7/00* (2006.01)
*B01F 7/28* (2006.01)
(Continued)

(52) U.S. Cl.
CPC ..... *B01F 7/00158* (2013.01); *B01F 7/004* (2013.01); *B01F 7/007* (2013.01);
(Continued)

(58) Field of Classification Search
CPC ..... B01F 7/00158; B01F 7/00183; B01F 7/0025; B01F 7/00633; B01F 7/007;
(Continued)

(56) References Cited

U.S. PATENT DOCUMENTS 277,876 A * 5/1883 Brown ..... F26B 9/085 34/181
2002/0031048 A1 3/2002 Lipp
(Continued)

FOREIGN PATENT DOCUMENTS

CN 201342327 Y * 11/2009
CN 201814489 5/2011
(Continued)

OTHER PUBLICATIONS

Machine translation of CN202449974, accessed via https://worldwide.espacenet.com/ on Apr. 9, 2019.*
(Continued)

*Primary Examiner* — Marc C Howell
(74) *Attorney, Agent, or Firm* — Morgan, Lewis & Bockius LLP

(57) ABSTRACT

This invention belongs to the field of biomass energy utilization at the large scale. A material stirring device for a biomass bin includes a transmission mechanism, a main stirring mechanism, and an auxiliary stirring mechanism. The main stirring mechanism includes a cylinder connected to the transmission mechanism. The outer wall of the cylinder is provided with a hollow stirring rod. The auxiliary stirring mechanism includes a rotating shaft vertically penetrating through the hollow stirring rod. Both ends of the
(Continued)

rotating shaft are provided with stirring blades and the rotating shaft is connected to the transmission mechanism. That the stirring device is easily damaged due to too high density of the biomass material is overcome through the automatic conversion adjustment of the main and auxiliary stirring mechanisms. The continuous discharge efficiency of the biomass bin is improved by the organic integration of over and partial stirring.

9 Claims, 1 Drawing Sheet

(51) Int. Cl.
*B01F 7/04* (2006.01)
*B01F 7/14* (2006.01)

(52) U.S. Cl.
CPC ..... *B01F 7/0025* (2013.01); *B01F 7/00058* (2013.01); *B01F 7/00183* (2013.01); *B01F 7/00633* (2013.01); *B01F 7/00641* (2013.01); *B01F 7/00725* (2013.01); *B01F 7/00983* (2013.01); *B01F 7/285* (2013.01); *B01F 7/04* (2013.01); *B01F 7/145* (2013.01)

(58) Field of Classification Search
CPC .. B01F 7/00983; B01F 7/285; B01F 7/00725; B01F 7/00691
USPC ..... 366/279
See application file for complete search history.

(56) References Cited

U.S. PATENT DOCUMENTS

| | | | | |
|---|---|---|---|---|
| 2003/0156492 | A1* | 8/2003 | Rumph | B01F 3/1221 366/270 |
| 2010/0317095 | A1* | 12/2010 | Schluter | B01F 7/00425 435/293.1 |
| 2013/0302117 | A1* | 11/2013 | Yu | B65D 88/68 414/301 |

FOREIGN PATENT DOCUMENTS

| | | | |
|---|---|---|---|
| CN | 202449974 U | * | 9/2012 |
| CN | 203494416 | | 3/2014 |
| CN | 104525015 | | 1/2015 |
| CN | 201067678 | | 4/2015 |

OTHER PUBLICATIONS

Machine translation of CN201342327, accessed via https://worldwide.espacenet.com/ on Apr. 9, 2019.*
International Search Report, for International Application No. PCT/CN15/082440, dated Oct. 22, 2015, 18 pages.

* cited by examiner

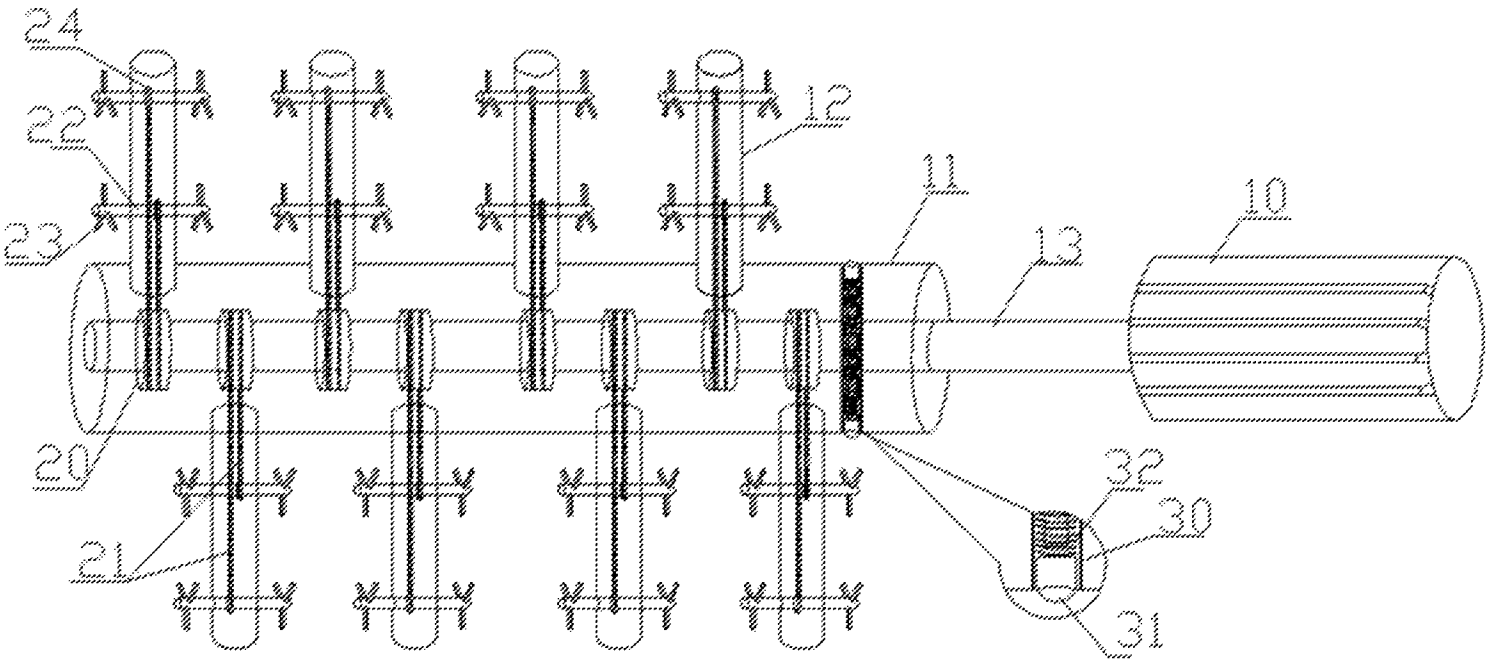
10
13
11
12
24
22
23
20
21
32
30
31

MATERIAL STIRRING DEVICE FOR BIOMASS BIN

RELATED APPLICATIONS

This application is the U.S. national stage application of International (PCT) Patent Application Ser. No. PCT/CN2015/082440, filed Jun. 26, 2015, which claims the benefit of Chinese Application No. 201510022409.8, filed Jan. 16, 2015. The entire disclosure of each of these applications is hereby incorporated by reference.

TECHNOSPHERE

This patent belongs to the field of biomass energy utilization at the large scale. It includes a material stirring device for a biomass bin.

BACKGROUND

Biomass energy derives from the ability of plants to use photosynthesis to convert solar energy into chemical energy and store that energy. Bioenergy provides nearly 15% of the world's total energy consumption and is the fourth-largest energy source after oil, coal, and natural gas. Bioenergy is the only form of renewable energy that can be collected, stored, and transported. It has widespread availability, is environmentally friendly, and has nearly zero carbon emissions, which are all important aspects of the six kinds of renewable energy. However, the biomass resource is a scattered resource with low energy density and is less efficient for storage and transportation, which delays its large-scale utilization.

Biomass briquette fuel (BBF) technology involves compressing unshaped raw materials into shaped and higher-density briquettes by drying, chopping, and forming processes, thereby reducing transportation and storage costs, improving the combustion quality, and generally expanding the scope of its application. BBF can be used not only for biomass gasification power generation, direct combustion power generation, and co-combustion power generation but also for industrial boilers, furnaces, and heating boilers, for example. Using BBF technology can realize energy savings from non-renewable resources such as coal and petroleum, improve the energy consumption structure, and reduce emissions of $CO_2$ and $SO_2$ to alleviate environmental pollution, promote new rural construction, achieve important energy savings, and expand the development of a low-carbon economy.

Biomass closely resembles coal in its physical and chemical characteristics. Therefore, using BBF with coal in combustion power generation is a reasonable use of biomass resources and reduces coal combustion pollution. Biomass and coal co-combustion power generation can not only relieve the pressure on non-renewable energy resources but can also resolve the instability of biomass power generation caused by seasonal variation in the availability of the biomass resource.

The biomass material must be stored after the agricultural residues have been crushed and before it is used in BBF and coal-based co-combustion power generation technology. Storage of the biomass material is the basic process that ensures stability and continuity of the co-combustion power generation operation. However, the density of the biomass material in a bin will change due to the shape, size, viscosity, moisture, density, flow, and porosity characteristics of the biomass material itself. It is difficult to transport a biomass material out of a biomass material bin. The limitation of the present material stirring systems is that the electrically powered systems are easily overloaded and damaged during prolonged use due to the cohesive tendency of the materials as well as when the material moisture content is too high and/or when the biomass material has low porosity.

INVENT CONTENT

The structure of the device is simple. The disadvantage that the stirring device is easily damaged due to a too high density of the biomass material is overcome through automatic conversion adjustment of the main and auxiliary stirring mechanisms. The continuous discharge efficiency of the biomass bin is improved by the organic integration of over and partial stirring. The stirring bin can be used in the biomass industry to enhance efficiency, reduce environmental pollution, and accelerate the implementation of biomass utilization at the large scale.

To resolve the above issues, the technology of this patent is as follows:

A material stirring device for a biomass bin includes a transmission mechanism, a main stirring mechanism, and an auxiliary stirring mechanism. The main stirring mechanism includes a cylinder connected to the transmission mechanism. The outer wall of the cylinder is provided with a hollow stirring rod. The auxiliary stirring mechanism includes a rotating shaft vertically penetrating through the hollow stirring rod. Both ends of the rotating shaft are provided with stirring blades and the rotating shaft is connected to the transmission mechanism.

Preferably, the transmission mechanism includes an electromotor; the electromotor is connected to the main stirring mechanism; the main stirring mechanism and the cylinder are in the same shaft.

Preferably, the main stirring mechanism and the cylinder are connected by spring catches.

Preferably, the spring catch includes a hollow catch; the hollow catch includes a spring with hemispherical balls on both ends of the spring. There are two holes in the cylinder to accommodate the hemispherical balls. The diameter of the hole is smaller than the hemispherical ball to ensure that the hemispherical ball cannot be divorced from the hole.

Preferably, there are several capstans fixed on the main stirring mechanism and several driven capstans fixed on the rotating shaft inside the hollow stirring rod. The capstans and driven capstans are connected to each other.

Preferably, the capstan and the driven capstan are all gears, which are connected by a chain.

Alternatively, the capstan and the driven capstan are all belt pulleys, which are connected by a belt.

Preferably, a series of stirring vanes are located on both sides of the rotating shaft and are equally spaced in the circumferential direction.

Preferably, the hollow stirring rods are located on the cylinder with an alternate permutation in the axial direction.

Preferably, there are at least six hollow stirring rods.

When the stirring device is working, the electromotor drives the main stirring mechanism. Under the condition of normal density of biomass material stored in the material bin, the hemispherical balls on both ends of the spring remain outside of the cylinder hall to ensure that there is sufficient resistance between the hemispherical balls and the halls and that the resistance is greater than the force between the main stirring mechanism and the biomass material. The main stirring mechanism can drive the cylinder hall by the spring catches, and the cylinder can drive the hollow stirring rods to stir the biomass material in the bin. The auxiliary stirring mechanism is not initiated.

Under the condition of abnormal density (high density) of biomass material stored in the material bin, there is too great a resistance between the biomass material and the hollow stirring rod and cylinder. The main stirring mechanism is driven by the electromotor and causes the spring catches to rotate. However, the resistance between the hemispherical balls and the holes is less than that between the biomass material and the hollow stirring rod and cylinder. Thus, the cylinder cannot rotate and the spring catches are compressed into the holes. The spring catches will be rotated by the main stirring mechanism, but the cylinder cannot be rotated. Finally, the main stirring mechanism drives the driven capstans through the capstans, and the driven capstans drive the rotating shaft. There are stirring blades on both sides of the rotating shaft. The stirring blades stir the biomass material and thereby lower the density. When the density of the material is too low to make the resistance between the hollow stirring rod and the cylinder smaller than that between the hemispherical balls and the holes, the hemispherical balls and the holes will join. The main stirring mechanism will drive the cylinder by the spring catches and the cylinder will drive the hollow stirring rods to stir the biomass material in the bin; the auxiliary stirring mechanism is not initiated.

Compared with previous technology, the invention has the following advantages.

The structure of the device is simple. The disadvantage that the stirring device is easily damaged due to a too high density of the biomass material is overcome through automatic conversion adjustment of the main and auxiliary stirring mechanisms. The continuous discharge efficiency of the biomass bin is improved by the organic integration of over and partial stirring. The stirring bin can be used in the biomass utilization industries to enhance efficiency, reduce environmental pollution, and accelerate the implementation of biomass utilization at the large scale.

FIGURE EXPLANATION

The figure is the structure of the material stirring device for a biomass bin.

IMPLEMENTATION MATTERS

The following explanation of the invention is provided to make the present invention clear in aim, technical scheme, and advantages. It should be understood that the specific explanations described herein shall be interpreted only in the interpretation of the invention and are not intended to be used to define the present invention.

The figure shows that the material stirring device for a biomass bin includes a transmission mechanism, a main stirring mechanism, and an auxiliary stirring mechanism. The transmission mechanism includes an electromotor 10; the electromotor 10 is connected to the main stirring mechanism 13; the main stirring mechanism 13 and the cylinder 11 are in the same shaft and are connected by the spring catches. The spring catch includes the hollow catch 12. The auxiliary stirring mechanism includes a rotating shaft 22 vertically penetrating through the hollow stirring rod 12; both ends of the rotating shaft 22 are provided with stirring blades 23. Driven capstans 24 are set on the rotating shaft 22 of the hollow catch 12. Several capstans 20 are set on the main stirring mechanism 13. The capstans 20 and the driven capstans 24 are connected to each other by chain 21.

The spring catch includes the hollow catch 30; the hollow catch 30 includes the spring 32 with hemispherical balls 31 on both ends of the spring. There are two holes in the cylinder 11 to accommodate the hemispherical balls 31 and the diameter of the hole is smaller than that of the hemispherical ball 31 to ensure that the hemispherical ball cannot be divorced from the hole.

When the material stirring device works, electromotor 10 drives the main stirring mechanism 13. If the density of the material in the bin is normal, the resistance between the hemispherical ball 31 and the hole is greater than the resistance between the biomass material and the cylinder 11, so that the hemispherical ball 31 can be driven by spring 32 and the hemispherical ball 31 passes out of the cylinder 11 through the hole. The cylinder 11 is run by the spring connected to the main stirring mechanism 13. The cylinder 11 stirs the biomass material through the hollow stirring rod 12, and the auxiliary stirring mechanism does not need to work.

Under the condition of abnormal density (high density) of biomass material stored in the material bin, there is too great a resistance between the biomass material and the hollow stirring rod 12 and the cylinder 11. The main stirring mechanism 13 is driven by the electromotor 10 and causes the spring catches to rotate. However, the resistance between the hemispherical balls 31 and the holes is less than that between the biomass material and the hollow stirring rod 12 and cylinder 11, so the cylinder 11 cannot rotate and the spring catches 31 are compressed into the holes. The spring catches will be rotated with the main stirring mechanism 13, but the cylinder 11 cannot be rotated. Finally, the main stirring mechanism 13 drives the driven capstans 24 through the capstans 20 and the chain 21. The driven capstans 24 drive the rotating shaft 22. There are stirring blades 23 on both sides of the rotating shaft 22. The stirring blades 23 stir the biomass material to lower the density. When the density of the material is so low that the resistance between the hollow stirring rod 12 and the cylinder 11 is less than that between the hemispherical balls 31 and the holes, the hemispherical balls 31 and the holes will join together again. The main stirring mechanism 13 will drive the cylinder 11 by the spring catches, the cylinder 11 will drive the hollow stirring rods 12 to stir the biomass material in the bin and the auxiliary stirring mechanism stops working.

INDUSTRIAL APPLICABILITY

In summary, the structure of the material stirring device for biomass bin is simple and ingeniously designed. That the stirring device is easily damaged due to too high density of the biomass material is overcome through the automatic conversion adjustment of the main and auxiliary stirring mechanisms. The continuous discharge efficiency of the biomass bin is improved by the organic integration of over and partial stirring. The stirring bin can be used in biomass energy utilization industries to enhance efficiency, reduce environmental pollution, and accelerate the implementation of biomass utilization at the large scale. The invention is suitable for industrialized production.

The invention claimed is:

1. A material stirring device for a biomass bin comprising:

a transmission mechanism;

a main stirring mechanism; and an auxiliary stirring mechanism, wherein:

the main stirring mechanism includes a cylinder connected to the transmission mechanism and having an outer wall, the outer wall of the cylinder is provided with a hollow stirring rod, the auxiliary stirring mechanism includes a rotating shaft vertically penetrating through the hollow stirring rod and having two ends, both ends of the rotating shaft are provided with stirring blades, the rotating shaft is connected to the transmission mechanism, and the main stirring mechanism and the cylinder are connected by spring catches.

2. The device of claim 1, wherein:

the transmission mechanism includes an electromotor;

the electromotor is connected to the main stirring mechanism; and the main stirring mechanism and the cylinder are in the same shaft.

3. The device of claim 1, wherein:

each spring catch includes a hollow catch, comprising a spring with hemispherical balls on both ends of the spring;

the cylinder comprises two holes therein used to locate the hemispherical balls; and a diameter of the holes is smaller than that of the hemispherical balls.

4. The device of claim 1, further comprising (i) a plurality of capstans fixed on the main stirring mechanism and (ii) a plurality of driven capstans fixed on the rotating shaft inside the hollow stirring rod, wherein the capstans and driven capstans are connected to each other.

5. The device of claim 4, wherein the capstans and the driven capstans are all gears, connected by a chain.

6. The device of claim 4, wherein the capstans and the driven capstans are all belt pulleys, connected by a belt.

7. The device of claim 4, wherein:

a plurality of groups of stirring vanes are located on both sides of the rotating shaft, and each group of stirring vanes comprises three vanes equally spaced in the circumferential direction.

8. The device of claim 4, wherein hollow stirring rods are located on the cylinder with alternate permutations in the axial direction.

9. The device of claim 8, wherein at least six hollow stirring rods are located on the cylinder.

* * * * *